United States Patent [19]

Takahashi et al.

[11] 3,952,157

[45] Apr. 20, 1976

[54] MATRIX FOUR-CHANNEL DECODING SYSTEM

[75] Inventors: Susumu Takahashi; Ryosuke Ito, both of Tokyo, Japan

[73] Assignee: Sansui Electric Co., Ltd., Tokyo, Japan

[22] Filed: Mar. 4, 1974

[21] Appl. No.: 447,759

[30] Foreign Application Priority Data

Mar. 7, 1973 Japan ..... 48-26726

[52] U.S. Cl. ..... 179/1 GQ; 179/100.4 ST

[51] Int. Cl.[2] ..... H04R 5/00

[58] Field of Search ..... 179/1 GQ, 100.4 ST, 179/1 G, 15 BT, 100.1 TD

[56] References Cited

UNITED STATES PATENTS

| | | | |
|---|---|---|---|
| 3,708,631 | 1/1973 | Bauer et al. | 179/1 GQ |
| 3,786,193 | 1/1974 | Tsurushima | 179/1 GQ |
| 3,825,684 | 7/1974 | Ito et al. | 179/1 GQ |
| 3,829,615 | 8/1974 | Hiramatsu | 179/1 GQ |
| 3,836,715 | 9/1974 | Ito et al. | 179/1 GQ |

*Primary Examiner*—Douglas W. Olms
*Attorney, Agent, or Firm*—Harris, Kern, Wallen & Tinsley

[57] ABSTRACT

A matrix four-channel decoding system wherein the mixing coefficients or mixing ratios of left and right composite signals of medium frequency range are continuously changed in accordance with the level conditions of directional audio input signals contained in the composite signals and the mixing coefficients or mixing ratios of the left and right composite signals of low and high frequency ranges are substantially fixed, thereby attaining the more natural four-channel reproduction.

14 Claims, 18 Drawing Figures

MATRIX FOUR-CHANNEL DECODING SYSTEM

This invention relates to a matrix four-channel decoding system.

A copending U.S. Pat. application Ser. No. 298,933, filed Oct. 19, 1972, now U.S. Pat. No. 3,825,689, sets forth a number of decoding systems which are characterized in that when first and second composite signals containing at least four left-front, left-back, right-front and right-back directional audio input signals encoded with preselected amplitude and phase relationships are converted into four left-front, left-back, right-front and right-back signals supplied to four loudspeakers surrounding a listener, then at least the mixing coefficients or mixing ratios of the composite signals are continuously changed according to the level relationship of the directional audio input signals contained in the composite signals, thereby attaining the more distinct separation of four-channel signals.

One of the above-mentioned decoding systems comprises first, second, third and fourth variable transmission means or variable gain amplifiers in order to vary the mixed state of the first and second composite signals contained in four output signals according to the condition of the directional audio input signals included in the first and second composite signals. The first and second variable transmission means are used to control the gains of difference and sum signals of the first and second composite signals respectively. The third and fourth variable transmission means are applied in controlling the gains of the first and second composite signals respectively. Output signals from the first and third variable transmission means are supplied to the first loudspeaker, output signals from the first and fourth variable transmission means to the second loudspeaker, output signals from the second and third variable transmission means to the third loudspeaker, and output signals from the second and fourth variable transmission means to the fourth loudspeaker.

Where there are provided matrix four-channel sources, it is often the customary practice to localize a low pitch musical instrument such as a bass or drum at the center between the front-left and front-right channels or between the back-left and back-right channels or at both centers, and to position a high pitch musical instrument such as a trumpet at the center between the front-left and back-left channels or between the front-right and back-right channels or at both centers. This arrangement originates with the consideration of preventing untruthful reproduced sounds from being delivered to a listener.

Where, however, it is tried to control the gains of signals of all frequencies by the above-mentioned variable transmission means, then there will arise the drawback that high frequency components (musical sounds and noises) will be shifted across the front and back channels, or low frequency components which should be localized at the front channels will be moved to the back channel side by the high frequency components localized in the back channels or the opposite event will take place, resulting in unnatural reproduction of sounds for the listener.

It is accordingly the object of this invention to provide a mixing coefficient varying-decoding system capable of providing a natural reproduction sound field.

This object is attained by widely varying the mixing coefficients or mixing ratios of composite signals of medium frequency range according to the level condition of directional audio input signals contained in the composite signals and substantially fixing the mixing coefficients or mixing ratios of composite signals of low and high frequency ranges, instead of widely changing the latter coefficients.

For the object of this invention the mixing coefficients or mixing ratios of composite signals of low frequency range may be fixed at different levels from those of composite signals of high frequency range.

In this case, it is preferred that the mixing coefficients of composite signals of low frequency range be so fixed as to elevate separation between the front and back channels and decrease separation between the left and right channels and the mixing coefficients of composite signals of high frequency range be so fixed as to attain a uniform separation between the four channels or to elevate separation between the left and right channels and reduce separation between the front and back channels.

Variation or fixation of the mixing coefficients of composite signals can be carried out by causing a plurality of variable transmission means each to be formed of a combination of a variable gain amplifier and filters, widely varying the signal transmission characteristics of the combination within the range of medium frequency and substantially fixing the signal transmission characteristics within low and high frequency ranges. To attain the above-mentioned object, it is also possible to install a mixing coefficient-varying decoder only supplied with composite signals of medium frequency range and one or two mixing coefficient-fixing decoders supplied with composite signals of low and high frequencies and mix corresponding output signals of the respective decoders.

A preferred embodiment of this invention comprises a first variable transmission means supplied with a difference signal of the composite signals so as to control separation between the front-left and front-right channels; a second variable transmission means supplied with a sum signal of the composite signals so as to control separation between the back-left and back-right channels; a third variable transmission means supplied with the first composite signal so as to control separation between the left-front and left-back channels; and a fourth variable transmission means supplied with the second composite signal so as to control separation between the right-front and right-back channels, thereby providing any desired reproduction pattern in low and high frequency bands by freely setting the gains of the first, second, third and fourth variable transmission means with respect to the low and high frequency signals.

This invention can be more fully understood from the following detailed description when taken in conjunction with the accompanying drawings, in which:

FIG. 1 is a block diagram of a decoding system according to an embodiment of this invention;

FIGS. 2 and 3 present the ranges within which the gain coefficients of the first to fourth variable transmission means shown in FIG. 1 are controlled;

FIG. 4 shows patterns of outputs reproduced from sound sources localized at various points where the matrix coefficients of the decoding system of FIG. 1 are changed;

FIGS. 5, 6 and 7 indicate reproduction patterns of various outputs where the matrix coefficients of the decoding system of FIG. 1 are fixed;

Figure 1:
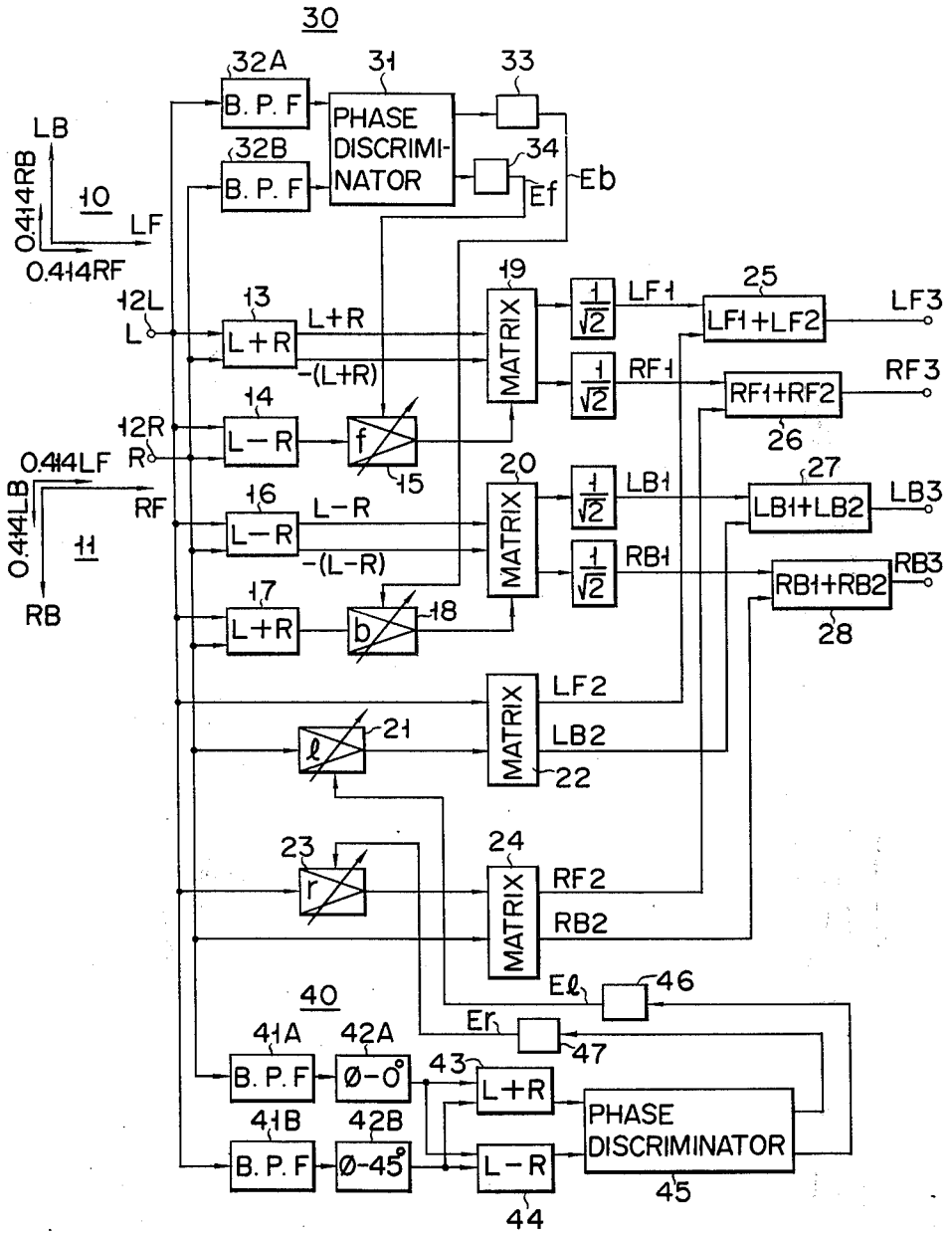

There will now be described by reference to FIG. 1 an embodiment of the decoding system of this invention. Input terminals 12L, 12R receive left and right composite signals L, R containing at least four directional audio input signals LF(left-front), RF(right-front), LB(left-back) and RB(right-back) vectorially composed as indicated at 10, 11, for example. The composite signals L, R are supplied to a matrix circuit 13 to form two sum signals (L+R), −(L+R). A matrix circuit 14 produces a difference signal L−R, whose amplitude is controlled by a first variable transmission means 15. A matrix circuit 16 forms two difference signals (L−R), −(L−R). A matrix circuit 17 generates a sum signal (L+R)whose amplitude is controlled by a second variable transmission means 18. Output signals from the matrix circuit 13 and an output signal from the first variable transmission means 15 are mixed by a matrix circuit 19 to form a left-front signal LF1 and a right-front signal RF1. Output signals from the matrix circuit 16 and an output signal from the second variable transmission means 18 are mixed by a matrix circuit 20 to produce a left-back signal LB1 and a right-back signal RB1. The right composite signal R has its amplitude controlled by a third variable transmission means 21 and is mixed with the left composite signal L by a matrix circuit 22 to form a left-front signal LF2 (L+*l*R) and a left-back signal LB2 (L−*l*R). The left composite signal L has its amplitude controlled by a fourth variable transmission means 23 and is mixed with the right composite signal R by a matrix circuit 24 to generate a right-front signal RF2 (R+*r*L) and a right-back signal RB2 (R−*r*L). The output signal LF1 from the matrix circuit 19 and the output signal LF2 from the matrix circuit 22 are mixed in the ratio of $$\frac{1}{\sqrt{2}} : 1$$

by a matrix circuit 25 to form a left-front signal LF3.

Right-front signals RF1, FR2 are mixed in the ratio of $$\frac{1}{\sqrt{2}} : 1$$

by a matrix circuit 26 to generate a right-front signal RF3. Left-back signals LB1, LB2 are mixed in the ratio of $$\frac{1}{\sqrt{2}} : 1$$

by a matrix circuit 27 to form a left-back signal LB3. Right-back signals RB1, RB2 are mixed in the ratio of $$\frac{1}{\sqrt{2}} : 1$$

by a matrix circuit 28 to form a right-back signal RB3. The above-mentioned four output signals LF3, RF3, LB3, RB3, are supplied to the loudspeakers through corresponding phase shifting circuits and power amplifiers (not shown).

The first and second input terminals 12L, 12R are connected to a first control unit 30 which comprises a first phase discriminator 31 supplied with the left and right composite signals L, R through bandpass filters 32A, 32B capable of passing signals having a frequency of 500 Hz to 7 kHz, for example. The first phase discriminator 31 detects the level relationship or level ratio between the front and back audio input signals contained in the left and right composite signals L, R in accordance with the phase difference between the composite signals L, R and generates two control signals whose voltage levels vary symmetrically in the opposite directions. These control signals are converted by correction circuits 33, 34 into first and second control signals Ef, Eb, in each of which voltage variations in positive and negative directions are unsymmetrical with respect to a referential voltage level. The first control signal Ef is conducted to the first variable transmission means 15 to control the gain or amplitude of the difference signal L-R. The second control signal Eb is supplied to the second variable transmission means 18 to control the gain or amplitude of the sum signal L+R.

The first and second input terminals 12L, 12R are also connected to a second control unit 40, which comprises bandpass filters 41A, 41B capable of passing signals having a frequency of, for example, 500 Hz to 7 kHz; phase shifters 42A, 42B for introducing between the composite signals L, R a relative phase difference of 45°, for example; matrix circuits 43, 44 for forming sum and difference signals of the composite signals L, R; and a phase discriminator 45 for detecting a phase difference between the sum and difference signals. This second control unit 40 detects the level relationship or level ratio between the left and right audio input signals contained in the left and right composite signals L, R and generates two control signals whose voltages vary symmetrically in the opposite directions. The two control signals thus generated are converted by correction circuits 46, 47 into third and fourth control signals E*l*, E*r*, in each of which voltage variations in positive and negative directions are unsymmetrical with respect to a referential voltage level. The third control signal E*l* is supplied to the third variable transmission means 21 to control the gain or amplitude of the right composite signal R. The fourth control signal E*r* is conducted to the fourth variable transmission means 23 to control the gain or amplitude of the left composite signal L.

In the foregoing embodiment, the first control unit 30 detects the level relationship between the front and back audio input signals contained in the left and right composite signals L, R in accordance with the phase difference between the composite signals L, R. The second control unit 40 detects the level relationship between the left and right audio signals contained in the left and right composite signals L, R in accordance with the phase relationship between the sum and difference signals of the composite signals L, R. However, in order to detect the level relationship between the front and back audio input signals, the first control unit 30 may include a level comparator for detecting the level relationship or ratio between the sum signal L+R and differemce signal L−R of the composite signals L, R, and the second control unit 40 may be formed of a level comparator for detecting the level relationship or ratio between the composite signals L, R in order to detect the level relationship between the left and right audio input signals. Further, the band pass filters 32A, 32B, 41A, 41B may be replaced by highpass filters capable of passing signals of higher frequency than, for example, 500 Hz.

Figure 2:
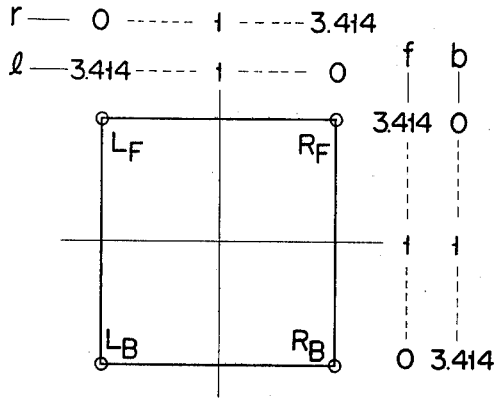
Figure 3:
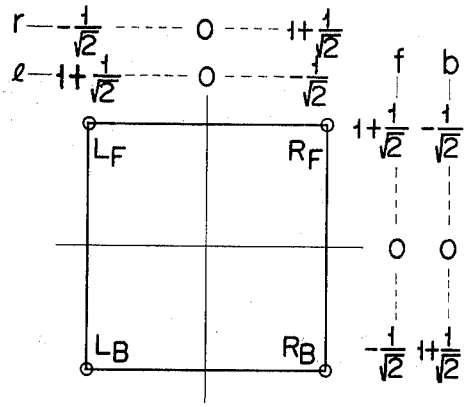

The first, second, third and fourth variable transmission means 15, 18, 21, 23 are used mainly to control separation between the front-left and front-right channels, separation between the back-left and back-right channels, separation between the left-front and left-back channels, and separation between the right-front and right-back channels, and each have variable gain coefficients *f*, *b*, *l*, *r* for input signals applied thereto which are changeable as shown in FIGS. 2 and 3. Where a sound source is in the front position as shown in FIG. 2, the variable coefficient *f* takes a maximum value of 3.414, and the variable coefficient *b* a minimum value of zero. Where a sound source is in the back position, the variable coefficient *f* indicates a minimum value of zero, and the variable coefficient *b* a maximum value of 3.414. Where a sound source is positioned at the center between the front and back channels, then both variable coefficients *f*, *b* have a value of 1. Where a sound source is disposed on the left side, the variable coefficient *l* takes a maximum value of 3.414, and the variable coefficient *r* a minimum value of zero. Where a sound source is on the right side, the variable coefficient *r* indicates a maximum value of 3.414, and the variable coefficient *l* a minimum value of zero. Where a sound source is located at the center between the left and right channels, both variable coefficients *l*, *r* have a value of 1. Thus the above-mentioned variable coefficients *f*, *b*, *l*, *r*, continuously change between a maximum value of 3.414 and a minimum value of zero according to the position of a sound source.

The variable coefficients *f*, *b*, *l*, *r* may also be changed between a maximum value of $$1 + \frac{1}{\sqrt{2}}$$

and a minimum value of $$-\frac{1}{\sqrt{2}}$$

as shown in FIG. 3. The center value of 1 in FIG. 2 and the center value of 0 in FIG. 3 are larger than the minimum value by an extent equal to $1/\sqrt{2}(\sqrt{2+1})$ times the latitude of control or variation (3.414 in FIG. 2 and $1+\sqrt{2}$ in FIG. 3).

Figure 4:
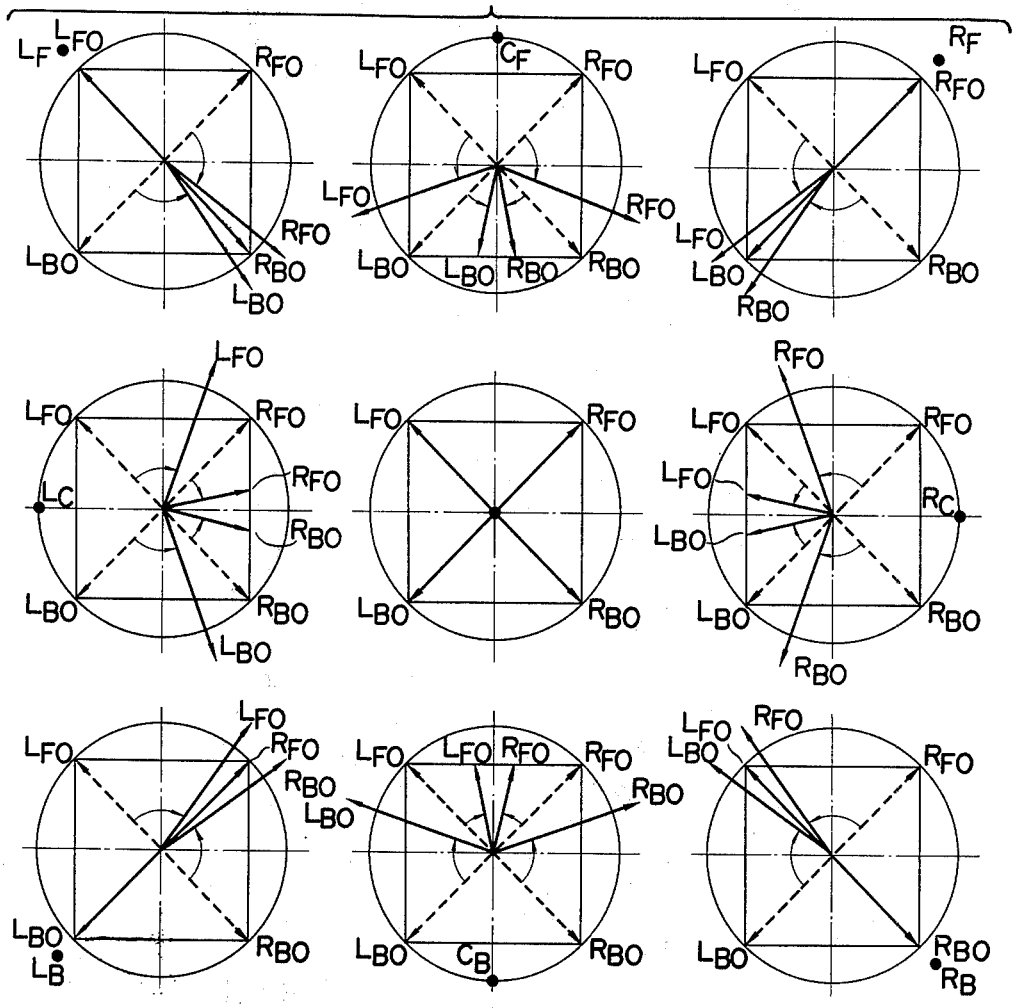

Output signals LF3, RF3, LB3, RB3 from the decoding system of FIG. 1 may respectively be expressed as follows:

$$LF3 = LF1 + LF2 = \frac{1}{\sqrt{2}}[(L+R) + f(L-R)] + L + lR$$

$$= \frac{1}{\sqrt{2}}[(1+f+\sqrt{2})L + (1-f+\sqrt{2}l)R] \quad (1)$$

$$RF3 = RF1 + RF2 = \frac{1}{\sqrt{2}}[(L+R) - f(L-R)] + R + rL$$

$$= \frac{1}{\sqrt{2}}[(1+f+\sqrt{2})R + (1-f+\sqrt{2}r)L] \quad (2)$$

$$LB3 = LB1 + LB2 = \frac{1}{\sqrt{2}}[(L-R) + b(L+R)] + L - lR$$

$$= \frac{1}{\sqrt{2}}[(1+b+\sqrt{2})L - (1-b+\sqrt{2}l)R] \quad (3)$$

$$RB3 = RB1 + RB2 = \frac{1}{\sqrt{2}}[-(L-R) + b(L+R)] + R - rL$$

$$= \frac{1}{\sqrt{2}}[(1+b+\sqrt{2})R - (1-b+\sqrt{2}r)L] \quad (4)$$

Where the variable coefficients *f*, *b*, *l*, *r* are separately controlled within a predetermined range by the first and second control units 30, 40, then the decoding system is operated to present reproduction patterns of FIG. 4 according to the positions of the sound sources and generates separation-enhanced output signals. The matrix-varying operation of the decoding system is already set forth in the aforesaid co-pending patent application, description thereof being omitted.

There will now be described outputs from the decoding system where the variable coefficients *f*, *b*, *l*, *r* each have a fixed value. It is assumed hereinafter that the coefficients *f*, *b*, *l* and *r* vary from zero to 3.414 as shown in FIG. 2. Where the coefficients *r*, *l* have a larger value than the coefficients *f*, *b*, for example, in case of $r=l=1$ and $f=b=0$, then the previously given equations may be rewritten as follows:

$$LF3 = \frac{1}{\sqrt{2}}(1+\sqrt{2})(L+R) \quad (5)$$

$$RF3 = \frac{1}{\sqrt{2}}(1+\sqrt{2})(L+R) \quad (6)$$

$$LB3 = \frac{1}{\sqrt{2}}(1+\sqrt{2})(L-R) \quad (7)$$

$$RB3 = \frac{1}{\sqrt{2}}(1+\sqrt{2})(R-L) \quad (8)$$

Figure 5:
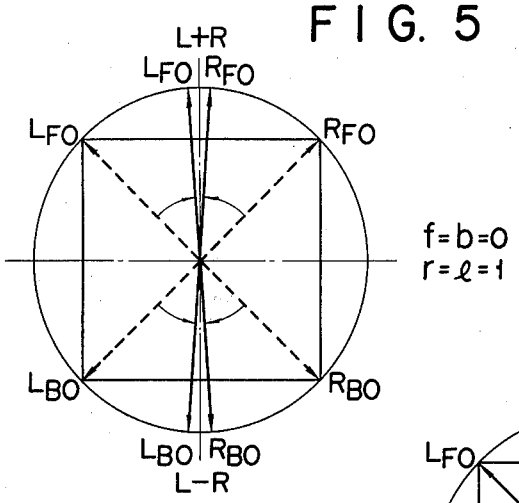

In this case, the front output signals LF3, RF3 represent the sum signals of the left and right composite signals L, R respectively, and the back output signals LB3, RB3 the difference signals of the composite signals L, R respectively, thus providing, as shown in FIG. 5, a longitudinally elongate reproduction pattern in which the left and right channel separation is reduced and the front and back channel separation is enhanced.

Where the coefficients *f*, *b*, *l*, *r* have an equal value of, for example, 3, then the previously given equations (1), (2), (3), (4) may be expressed as follows:

$$LF3 = \frac{1}{\sqrt{2}}(1+\sqrt{2}+3)[L+(\sqrt{2}-1)R] = \frac{1}{\sqrt{2}}5.414\ (L+0.414R) \quad (9)$$

$$RF3 = \frac{1}{\sqrt{2}}(1+\sqrt{2}+3)[R+(\sqrt{2}-1)L] = \frac{1}{\sqrt{2}}5.414\ (R+0.414L) \quad (10)$$

$$LB3 = \frac{1}{\sqrt{2}}(1+\sqrt{2}+3)[L-(\sqrt{2}-1)R] = \frac{1}{\sqrt{2}}5.414\ (L-0.414R) \quad (11)$$

$$RB3 = \frac{1}{\sqrt{2}}(1+\sqrt{2}+3)[R-(\sqrt{2}-1)L] = \frac{1}{\sqrt{2}}5.414\ (R-0.414L) \quad (12)$$

Figure 6:
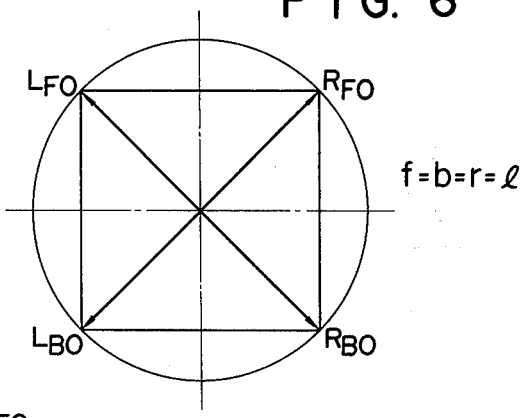

In this case, an equal separation (−3db) is attained between the adjacent channels, presenting a square reproduction pattern as illustrated in FIG. 6.

Where the coefficients $f$, $b$ have a larger value than the coefficients $r$, $l$, for example, in case of $f=b=1$ and $r=l=0$, then the previously given equations (1), (2), (3), (4) may be indicated as follows:

$$LF3 = (1+\sqrt{2})L \quad (13)$$

$$RF3 = (1\sqrt{2})R \quad (14)$$

$$LB3 = (1+\sqrt{2})L \quad (15)$$

$$RB3 = (1+\sqrt{2})R \quad (16)$$

Figure 7:
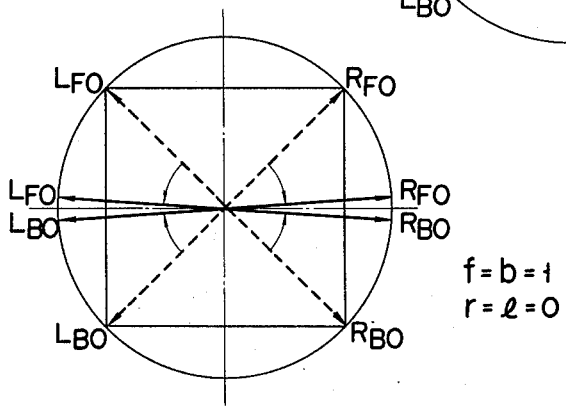

In this case, there is produced, as shown in FIG. 7, a laterally elongate reproduction pattern in which the left and right channel separation is greatly enhanced and the front and back channel separation is reduced.

In case of $f>r=l>b$, there is obtained an inverted trapezoidal reproduction pattern in which separation between the front-left and front-right channels is larger than separation between the back-left and back-right channels.

As apparent from the foregoing description, an increased coefficient $f$ provides a large separation between the front-left and front-right channels. An increased coefficient $b$ attains a large separation between the back-left and back-right channels. An increased coefficient $l$ gives a large separation between the left-front and left-back channels. An increased coefficient $r$ results in a large separation between the right-front and right-back channels. It will be noted that separation between a pair of channels is not determined entirely by a single coefficient, but by an interrelationship or ratio between one coefficient and the other coefficients. For example, if, in case the coefficients $f$, $b$, $r$, $l$ are set at an equal value to effect a uniform separation between the respective adjacent channels, the coefficient $f$ alone is made to increase, then separation between the front-left and front-right channels can be enlarged, but separation between the other channels is conversely reduced.

There will now be described the operation of a plurality of variable transmission means which are capable of varying the matrix coefficients $f$, $b$, $r$, $l$ with respect to signals of medium frequency, though substantially fixing the coefficients in connection with signals of low and high frequencies.

Figure 8:
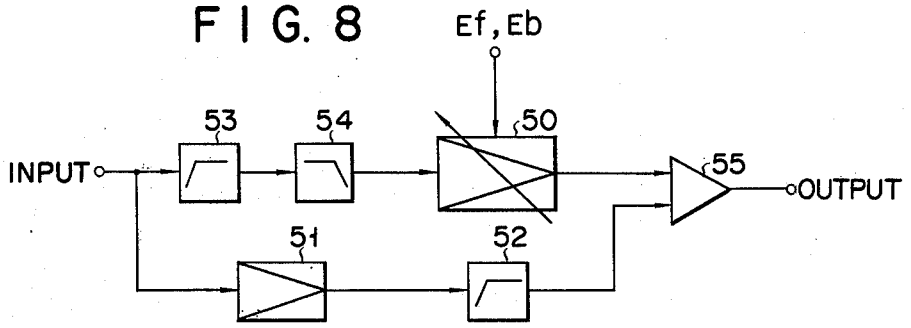
FIG. 8 is a concrete block diagram common to the first and second variable transmission means of FIG. 1.
Figure 14:
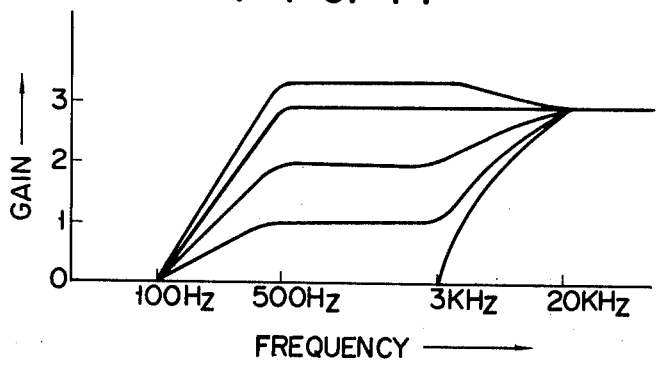
FIG. 14 is a curve diagram showing the frequency characteristics of the variable transmission means of FIG. 8.

FIG. 8 is a block diagram common to the first and second variable transmission means 15, 18. Each of these transmission means 15, 18 comprises a variable gain amplifier 50, amplifier 51, highpass filters 52, 53, lowpass filter 54 and mixer 55. When an input signal passes through the highpass and lowpass filters 53, 54 in succession, a component of medium frequency alone is supplied to the variable gain amplifier 50. When a high frequency component obtained by the passage of an input signal through the highpass filter 52 and an output signal of medium frequency from the variable gain amplifier 50 are mixed, then the first and second variable transmission means 15, 18 indicate such frequency characteristics as shown in FIG. 14. Accordingly, variation latitude of the gain coefficients $f$, $b$ of the first and second variable transmission means 15, 18 varies, as shown in FIG. 14, progressively less as the frequency decreases because the filters have no abrupt frequency characteristics and when the frequency reaches a predetermined frequency of 100 Hz, for example, the gain coefficients are substantially brought to zero. The variation latitude of gain coefficients varies progressively less as the frequency rises, and the coefficients are fixed at, for example, 3 when the frequency reaches a predetermined frequency of 20 kHz, for example, only with respect to signals of medium frequency band, the variation latitude of the gain coefficients is large.

Figure 9:
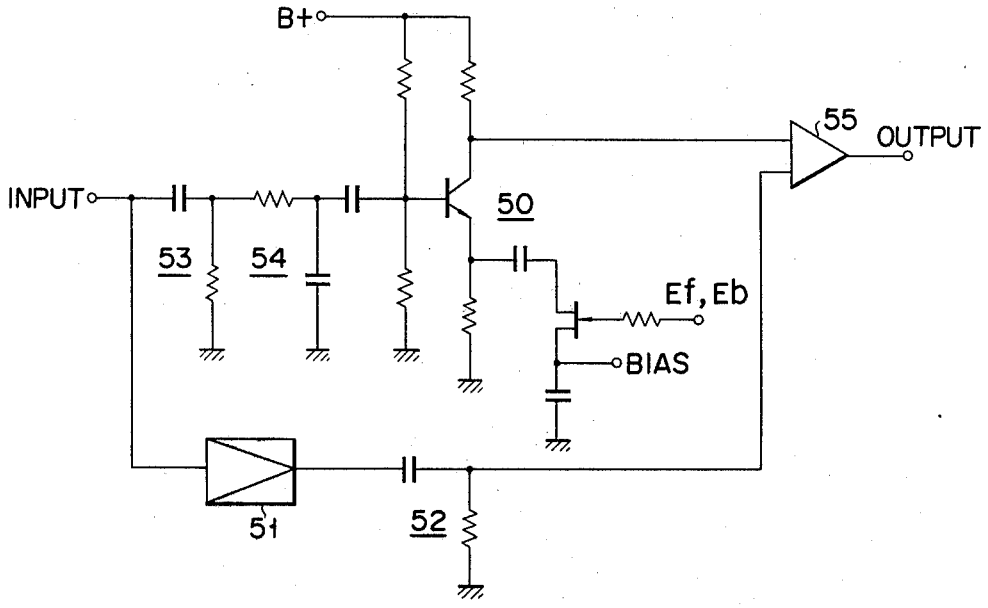
FIGS. 9 and 10 are concrete circuit diagrams of FIG. 8.
Figure 10:
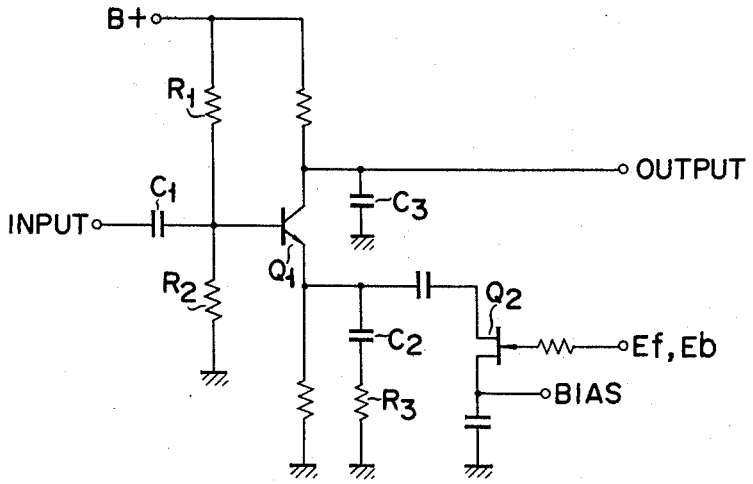

FIG. 9 is a circuit diagram of the variable transmission means of FIG. 8. The parts of FIG. 9 the same as those of FIG. 8 are denoted by the same numerals and description thereof is omitted. FIG. 10 is a circuit diagram, where the variable gain amplifier 50 of FIG. 9 is provided with various types of filter. According to FIG. 10, a highpass filter is formed of a capacitance C1, resistances R1, R2 and the input impedance of a transistor Q1. The emitter of the transistor Q1 is grounded by an impedance circuit consisting of a capacitor C2 and resistor R3. With respect to signals of high frequency, therefore, the gain of the transistor Q1 increases without being substantially affected by the internal resistance of a field effect transistor Q2. On the other hand, the gain is decreased with respect to signals of high frequency by a capacitor C3 connected to the collector of the transistor Q1. Therefore, the gain of the transistor Q1 with respect to signals of high frequency is substantially fixed by means of the capacitors C2, C3 independently of the operation of the field effect transistor Q2, thereby enabling the variable transmission means 15, 18 to fulfil the frequency characteristics of FIG. 14.

Figure 11:
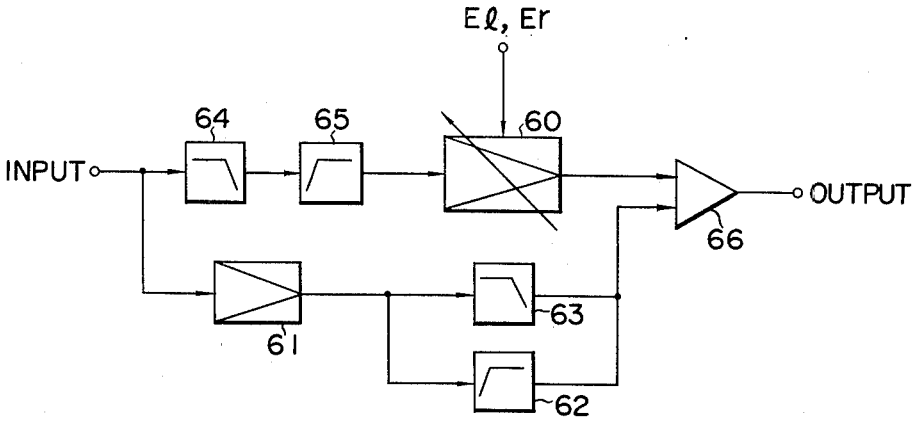
FIG. 11 is a concrete block diagram of the third and fourth variable transmission means of FIG. 1.

The third and fourth variable transmission means 21, 23 may be composed of a variable gain amplifier 60, amplifier 61, lowpass filters 63, 64, highpass filters 62, 65 and mixer 66, as shown in FIG. 11. By passing an input signal through the lospass and highpass filters 64, 65 connected in series a medium frequency component alone is supplied to the variable gain amplifier 60. When low frequency and high frequency components obtained by the passage of an input signal through the lowpass and highpass filters 63 and 62 respectively are mixed with an output signal of medium frequency band from the variable gain amplifier 60, then the third and fourth variable transmission means 21, 23 have frequency characteristics as shown in FIG. 15.

Figure 15:
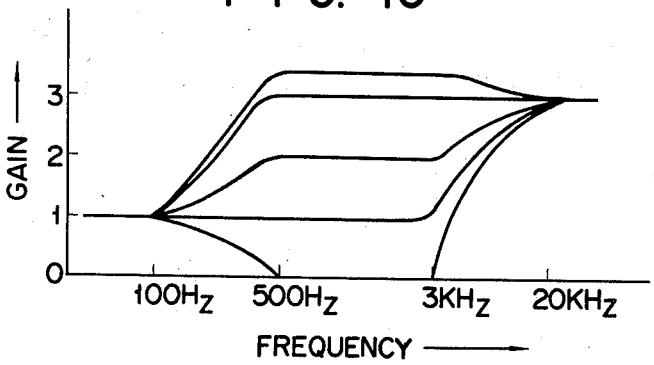
FIG. 15 is a curve diagram showing the frequency characteristics of the variable transmission means of FIG. 11.

The variation latitude of gain coefficients *l*, *r* of the third and fourth variable transmission means 21, 23 varies progressively less, as shown in FIG. 15 as the frequency decreases, and the coefficients are fixed at, for example, 1 when the frequency reaches a predetermined frequency of 100 Hz, for example. The variation latitude of coefficients also varies progressively less as the frequency rises, and the coefficients are fixed at, for example, 3 when the frequency reaches a predetermined frequency of 20 kHz, for example. The variation latitude of the coefficients *l*, *r* is large only with respect to signals of medium frequency.

Figure 12:
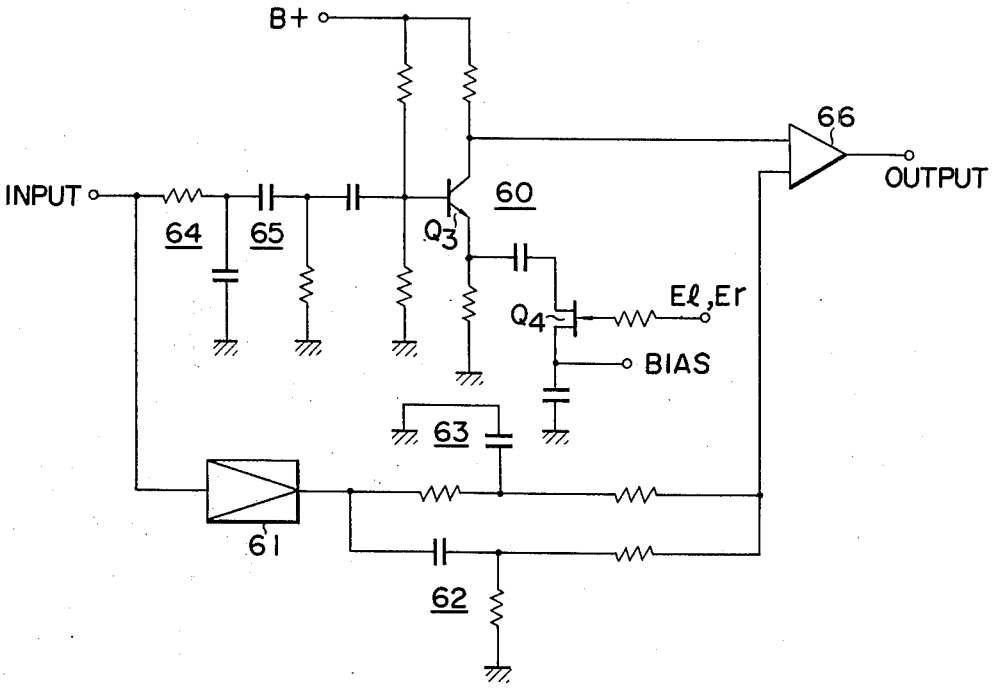
FIGS. 12 and 13 are concrete circuit diagrams of the variable transmission means of FIG. 11.
Figure 13:
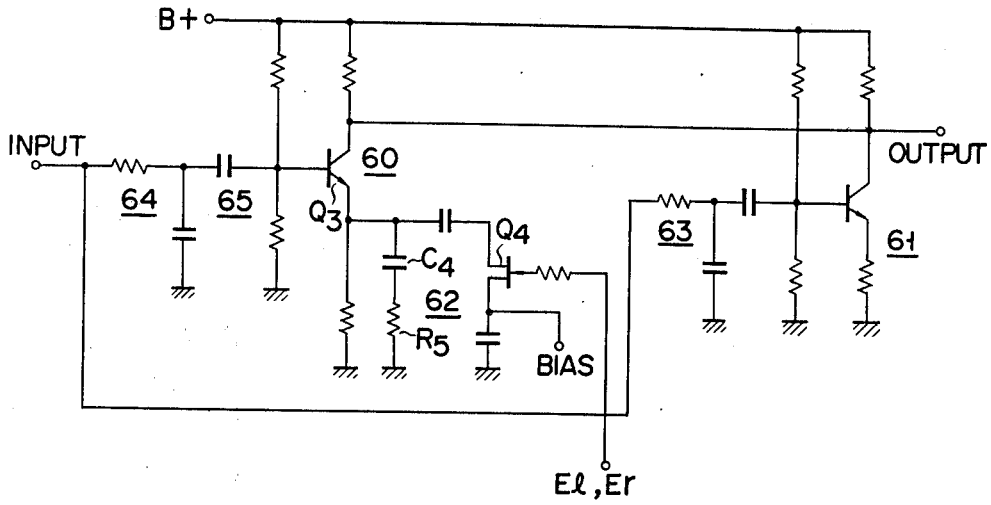

FIG. 12 is a concrete circuit diagram of FIG. 11. The parts of FIG. 12 the same as those of FIG. 11 are denoted by the same numerals and description thereof is omitted. FIG. 13 is a modification of FIG. 12. According to FIG. 13, a highpass filter 62 consisting of series connected capacitor C4 and resistor R5 is connected between the emitter of transistor Q3 and ground. The gain of transistor Q3 with respect to signals of high frequency is fixed at a substantially high level, regardless of the operation of a field effect transistor Q4.

Where, in the decoding system of FIG. 1, the first and second variable transmission means 15, 18 show the frequency characteristics of FIG. 14 and the third and fourth variable transmission means 21, 23 indicate the frequency characteristics of FIG. 15, then the gain coefficients *f*, *b* of first and second transmission means 15, 18 are substantially converged to zero and the gain coefficients *r*, *l* of third and fourth variable transmission means 21, 23 substantially to 1 with respect to low frequency signals, then there is obtained the reproduction pattern of FIG. 5 in which separation between the front and back channels is increased and separation between the left and right channels is decreased. With respect to high frequency signals, the gain coefficients *f*, *b*, *r*, *l* are all converged substantially to 3, providing the reproduction pattern of FIG. 6 with an equal separation between the respective adjacent channels.

With respect to signals of medium frequency band, the gain coefficients *f*, *b*, *r*, *l* are prominently controlled according to the level relationship of directional audio input signals contained in the left and right composite signals L, R, thereby generating distinctly separation enhanced output signals.

Figure 16:
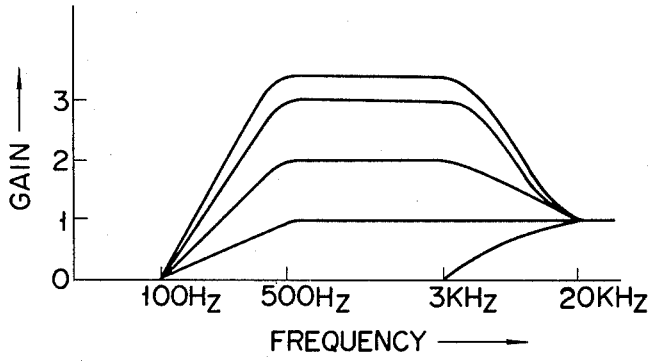
FIG. 16 is a curve diagram showing the other frequency characteristics of the first and second variable transmission means.
Figure 17:
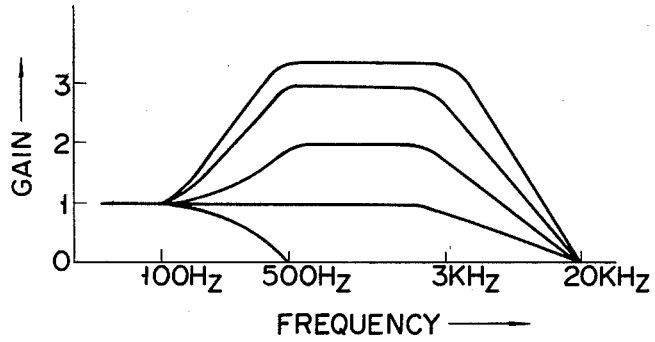
FIG. 17 is a curve diagram showing the other frequency characteristics of the third and fourth variable transmission means.

It is also possible to cause the first and second variable transmission means 15, 18 to have such frequency characteristics that the gain coefficients *f*, *b* are fixed, as shown in FIG. 16, substantially at zero with respect to low frequency signals and substantially at 1 with respect to high frequency signals, and also cause the third and fourth variable transmission means 21, 23 to have such frequency characteristics that the gain coefficients *l*, *r* are converged, as shown in FIG. 17, substantially to 1 with respect to low frequency signals and substantially to zero with respect to high frequency signals. In this case, such reproduction pattern as shown in FIG. 5 is obtained with respect to low frequency signals, and such reproduction pattern as illustrated in FIG. 7 in which separation between the left and right channels increases and separation between the front and back channels decreases is produced with respect to high frequency signals.

Figure 18:
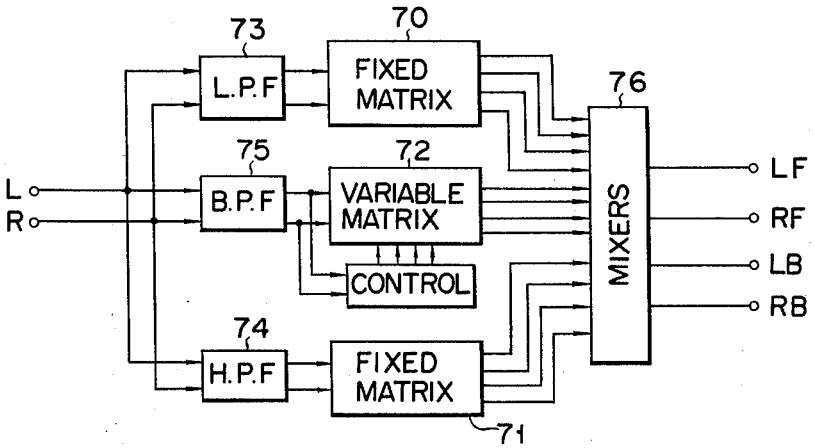
FIG. 18 is a block diagram of a decoding system according to another embodiment of this invention.

The frequency characteristics of the first to fourth variable transmission means need not be limited to those described in connection with the preceding embodiments but may be freely defined. According to the foregoing embodiments, the respective variable transmission means were constructed to have such frequency characteristics as to cause the matrix coefficients to be fixed with respect to high and low frequency signals. However, the decoding system of this invention may be composed, as shown in FIG. 18, of a fixed matrix circuit 70 for combining the low frequency composite signals with preselected mixing coefficients, a fixed matrix circuit 71 for combining the high frequency composite signals with preselected mixing coefficients and a variable matrix circuit 72 for medium frequency signals. Namely, it is possible to supply low frequency composite signals to the fixed matrix circuit 70 through a lowpass filter 73, medium frequency composite signals to the variable matrix circuit 72 through a bandpass filter 75, and high frequency composite signals to the fixed matrix circuit 71 through a highpass filter 74, mix corresponding output signals from the respective matrix circuits 70, 71, 72 by mixers 76 so as to produce four output signals LF, RF, LB, RB.

Although the invention has been shown and described in terms of two embodiments thereof, it will be clear that many changes and modifications will be obvious to those skilled in the art without departing from the true spirit and scope of the invention as defined in the appended claims.

What we claim is:

1. A decoding system for converting first and second composite signals containing at least front-left, front-right, back-left and back-right directional audio input signals encoded with preselected amplitude and phase relationships into four output signals being coupled to four loudspeakers disposed around a listener, which comprises control means for detecting level relationships of directional audio input signals in the first and second composite signals and matrix means for producing output signals while varying the mixing coefficients of the first and second composite signals in accordance with the level relationship of directional audio input signals, the improvement wherein said matrix means is operative to vary the mixing coefficients of the first and second composite signals of medium frequency band in accordance with the level relationship of the directional audio input signals and also substantially to fix the mixing coefficients of the first and second composite signals of low and high frequency bands; and is operative to fix the mixing coefficients of the first and second composite signals of low frequency band to different values from those of the first and second composite signals of high frequency band.

2. A decoding system for converting first and second composite signals containing at least front-left, front-right, back-left and back-right directional audio input signals encoded with preselected amplitude and phase relationships into four output signals being coupled to four loudspeakers disposed around a listener, which comprises control means for detecting level relationships of directional audio input signals in the first and second composite signals and matrix means for producing output signals while varying the mixing coefficients of the first and second composite signals in accordance with the level relationship of directional audio input signals, the improvement wherein said matrix means is operative to vary the mixing coefficients of the first and second composite signals of medium frequency band in accordance with the level relationship of the directional audio input signals and also substantially to fix the mixing coefficients of the first and second composite signals of low and high frequency bands; and is operative to fix the mixing coefficients of the first and second composite signals in low frequency band to larger values than those of the first and second composite signals in high frequency band, to thereby make left and right channel separation in high frequency band more prominent than that in low frequency band.

3. A decoding system for converting first and second composite signals containing at least front-left, front-right, back-left and back-right directional audio input signals encoded with preselected amplitude and phase relationships into four output signals being coupled to four loudspeakers disposed around a listener, which comprises control means for detecting level relationships of directional audio input signals in the first and second composite signals and matrix means for producing output signals while varying the mixing coefficients of the first and second composite signals in accordance with the level relationship of directional audio input signals, the improvement wherein said matrix means comprises a plurality of variable transmission means adapted to vary the mixing coefficients of the first and second composite signals, said variable transmission means having gain coefficients for input signals applied thereto and having a medium frequency path and a high frequency path and being operative to vary the gain coefficients for input signals in the medium frequency path differently from those for input signals in the high frequency path.

4. A decoding system as defined in claim 3 with said variable transmission means having a medium frequency path, a high frequency path and a low frequency path and being operative to vary the gain coefficients for input signals in the medium frequency path differently from those for input signals in the high and low frequency paths.

5. A decoding system for converting first and second composite signals containing at least front-left, front-right, back-left and back-right directional audio input signals encoded with preselected amplitude and phase relationships into four output signals being coupled to four loudspeakers disposed around a listener, which comprises control means for detecting level relationships of directional audio input signals in the first and second composite signals and matrix means for producing output signals while varying the mixing coefficients of the first and second composite signals in accordance with the level relationship of directional audio input signals, the improvement wherein said matrix means is operative to vary the mixing coefficients of the first and second composite signals of medium frequency band in accordance with the level relationship of the directional audio input signals and also substantially to fix the mixing coefficients of the first and second composite signals of low and high frequency bands;

said matrix means comprising first, second, third and fourth variable transmission means adapted to vary the mixing coefficients of the first and second composite signals and having gain coefficients for input signals applied thereto for mainly controlling front-left and right channel separation, back-left and right channel separation, left-front and back channel separation and right-front and back channel separation, respectively, said first, second, third and fourth variable transmission means being operative to vary the gain coefficients for input signals of medium frequency band and to substantially fix the gain coefficients for input signals of low and high frequency bands;

with, in at least one frequency band in which said first, second, third and fourth variable transmission means perform gain coefficient fixing operation, said third and fourth variable transmission means being operative to fix the gain coefficients thereof to preselected values larger than those to which said first and second variable transmission means fix the gain coefficients thereof, to thereby decrease left and right channel separation and increase front and back channel separation.

6. A decoding system according to claim 5 wherein said first variable transmission means is connected to receive a difference signal of the first and second composite signals, said second variable transmission means to receive a sum signal of the first and second composite signals, said third variable transmission means to receive the second composite signal and said fourth variable transmission means to receive the first composite signal.

7. A decoding system according to claim 5 wherein, in at least one frequency range in which said first, second, third and fourth variable transmission means perform gain coefficient fixing operation, said first, second, third and fourth variable transmission means are operative to fix the gain coefficients to a substantially equal value, to thereby make separations between respective adjacent channels equal to each other.

8. A decoding system for converting first and second composite signals containing at least front-left, front-right, back-left and back-right directional audio input signals encoded with preselected amplitude and phase relationships into four output signals being coupled to four loudspeakers disposed around a listener, which comprises control means for detecting level relationships of directional audio input signals in the first and second composite signals and matrix means for producing output signals while varying the mixing coefficients of the first and second composite signals in accordance with the level relationship of directional audio input signals, the improvement wherein said matrix means is operative to vary the mixing coefficients of the first and second composite signals of medium frequency band in accordance with the level relationship of the directional audio input signals and also substantially to fix the mixing coefficients of the first and second composite signals of low and high frequency bands;

said matrix means comprising first means for mixing the first and second composite signals of at least one frequency band other than medium frequency band with preselected mixing coefficients to generate four output signals, second means for mixing the first and second composite signals of the medium frequency band with the mixing coefficients which vary in response to the level relationships of the directional audio input signals to produce four output signals; and third means for mixing the corresponding output signals from said first and second means.

9. A decoding system for converting first and second composite signals containing at least front-left, front-right, back-left and back-right directional audio input signals encoded with preselected amplitude and phase relationships into four output signals being coupled to four loudspeakers disposed around a listener, which comprises control means for detecting level relationships of directional audio input signals in the first and second composite signals and matrix means for producing output signals while varying the mixing coefficients of the first and second composite signals in accordance with the level relationship of directional audio input signals, the improvement wherein said matrix means is operative to vary the mixing coefficients of the first and second composite signals of medium frequency band in accordance with the level relationship of the directional audio input signals and also substantially to fix the mixing coefficients of the first and second composite signals of low and high frequency bands;

said matrix means comprising first, second, third and fourth variable transmission means adapted to vary the mixing coefficients of the first and second composite signals and having gain coefficients for input signals applied thereto for mainly controlling the front-left and right channel separation, back-left and right channel separation, left-front and back channel separation and right-front and back channel separation, respectively, said first, second, third and fourth variable transmission means being operative to vary the gain coefficients for input signals of medium frequency band and to substantially fix the gain coefficients for input signals of low and high frequency bands;

with, in at least one frequency range in which said first, second, third and fourth variable transmission means perform gain coefficient fixing operation, said first and second variable transmission means being operative to fix the gain coefficients to preselected values larger than those to which said third and fourth variable transmission means fix the gain coefficients thereof, to thereby increase left and right channel separation and decrease front and back channel separation.

10. A decoding system according to claim 9 wherein said first variable transmission means is connected to receive a difference signal of the first and second composite signals, said second variable transmission means to receive a sum signal of the first and second composite signals, said third variable transmission means to receive the second composite signal and said fourth variable transmission means to receive the first composite signal.

11. A decoding system for converting first and second composite signals containing at least front-left, front-right, back-left and back-right directional audio input signals encoded with preselected amplitude and phase relationships into four output signals being coupled to four loudspeakers disposed around a listener, which comprises control means for detecting level relationships of directional audio input signals in the first and second composite signals and matrix means for producing output signals while varying the mixing coefficients of the first and second composite signals in accordance with the level relationship of directional audio input signals, the improvement wherein said matrix means is operative to vary the mixing coefficients of the first and second composite signals of medium frequency band in accordance with the level relationship of the directional audio input signals and also substantially to fix the mixing coefficients of the first and second composite signals of low and high frequency bands;

said matrix means comprising first, second, third and fourth variable transmission means adapted to vary the mixing coefficients of the first and second composite signals and having gain coefficients for input signals applied thereto for mainly controlling front-left and right channel separation, back-left and right channel separation, left-front and back channel separation and right-front and back channel separation, respectively, said first, second, third and fourth variable transmission means being operative to vary the gain coefficients for input signals of medium frequency band and to substantially fix the gain coefficients for input signals of low and high frequency bands;

with, in the low frequency band, said third and fourth variable transmission means being operative to fix the gain coefficients thereof to preselected values larger than those to which said first and second variable transmission means fix the gain coefficients thereof, and, in the high frequency band, said first and second variable transmission means being operative to fix the gain coefficients thereof to preselected values larger than those to which third and fourth variable transmission means fix the gain coefficients thereof.

12. A decoding system according to claim 11 wherein said first variable transmission means is connected to receive a difference signal of the first and second composite signals, said second variable transmission means to receive a sum signal of the first and second composite signals, said third variable transmission means to receive the second composite signal and said fourth variable transmission means to receive the first composite signal.

13. A decoding system for converting first and second composite signals containing at least front-left, front-right, back-left and back-right directional audio input signals encoded with preselected amplitude and phase relationships into four output signals being coupled to four loudspeakers disposed around a listener, which comprises control means for detecting level relationships of directional audio input signals in the first and second composite signals and matrix means for producing output signals while varying the mixing coefficients of the first and second composite signals in accordance with the level relationship of directional audio input signals, the improvement wherein said matrix means is operative to vary the mixing coefficients of the first and second composite signals of medium frequency band in accordance with the level relationship of the directional audio input signals and also substantially to fix the mixing coefficients of the first and second composite signals of low and high frequency bands;

said matrix means comprising first, second, third and fourth variable transmission means adapted to vary the mixing coefficients of the first and second composite signals and having gain coefficients for input signals applied thereto for mainly controlling front-left and right channel separation, back-left and right channel separation, left-front and back channel separation and right-front and back channel separation, respectively, said first, second, third and fourth variable transmission means being operative to vary the gain coefficients for input signals of medium frequency band and to substantially fix the gain coefficients for input signals of low and high frequency bands;

with, in the low frequency band, said third and fourth variable transmission means being operative to fix the gain coefficients to preselected values larger than those to which said first and second variable transmission means fix the gain coefficients thereof, and, in the high frequency band, said first, second, third and fourth variable transmission means being operative to fix the gain coefficients thereof to a substantially equal value.

14. A decoding system according to claim 13 wherein said first variable transmission means is connected to receive a difference signal of the first and second composite signals, said second variable transmission means to receive a sum signal of the first and second composite signals, said third variable transmission means to receive the second composite signal and said fourth variable transmission means to receive the first composite signal.

* * * * *